United States Patent [19]

Borghi

[11] 4,080,769

[45] Mar. 28, 1978

[54] ANNULAR STRUCTURES FOR THE ERECTION OF BUILDINGS

[76] Inventor: Sergio Borghi, Via Trieste 35, 56100 Pisa, Italy

[21] Appl. No.: 665,583

[22] Filed: Mar. 10, 1976

[30] Foreign Application Priority Data

Mar. 10, 1975 Italy ..... 21093/75

[51] Int. Cl.[2] ..... E04C 1/30

[52] U.S. Cl. ..... 52/582; 52/79.1; 52/220

[58] Field of Search ..... 52/582–586, 52/80, 82, 200, 245, 237, 276, 284, 285, 17, 79.1, 79.9, 220, 272, 277

[56] References Cited

U.S. PATENT DOCUMENTS

| | | | |
|---|---|---|---|
| 2,116,021 | 5/1938 | Gauvin | 52/277 X |
| 2,949,867 | 8/1960 | Ramsey | 52/582 X |
| 3,102,610 | 9/1963 | Shelby | 52/220 X |
| 3,129,793 | 4/1964 | Ferrell | 52/272 X |
| 3,188,131 | 6/1965 | Attwood | 52/284 X |
| 3,296,759 | 1/1967 | Pavlecka | 52/277 X |
| 3,385,183 | 5/1968 | Kortz | 52/582 X |
| 3,486,285 | 12/1969 | Bowling et al. | 52/284 |
| 3,505,765 | 4/1970 | Blaski | 52/80 |
| 3,872,620 | 3/1975 | Daenen | 52/582 X |
| 3,962,835 | 6/1976 | Little | 52/220 X |

FOREIGN PATENT DOCUMENTS

| | | | |
|---|---|---|---|
| 1,227,864 | 4/1971 | United Kingdom | 52/220 |

*Primary Examiner*—J. Karl Bell

[57] ABSTRACT

For the building of roomed structures there are provided two kinds of modular units which respectively form walls, and floors or ceilings. Two of each kind of unit can be bolted together to form an annular assembly. A plurality of annular assemblies can be bolted end to end to form a tube. The external faces of the units are shaped such as, when opposed to another similar unit, to define channels for air conditioning, electrical services, and the like, and other spaces to receive reinforcement and poured concrete for horizontal cross beams, and vertical pillars to support the cross beams.

6 Claims, 9 Drawing Figures

4

Fig. 6
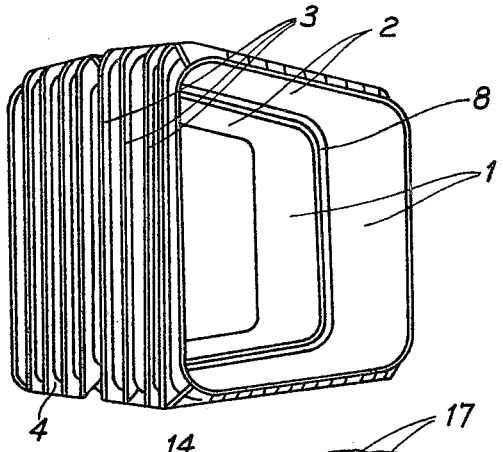
Fig. 7
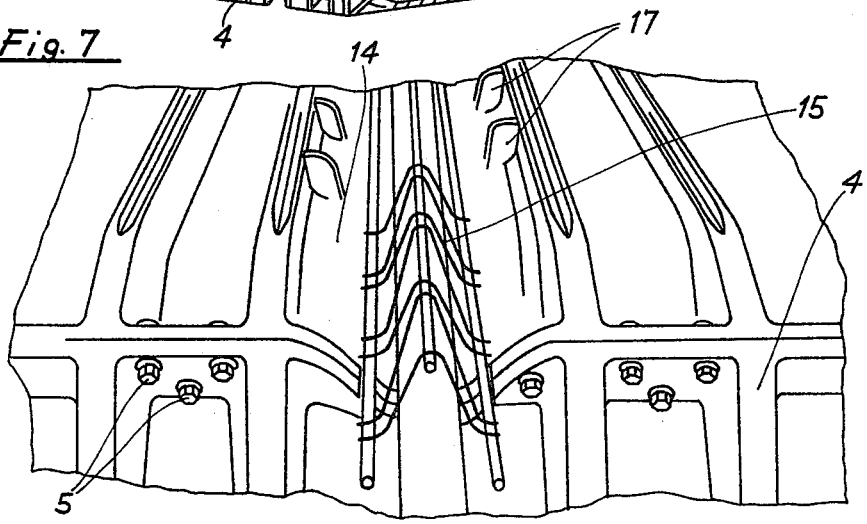
Fig. 8
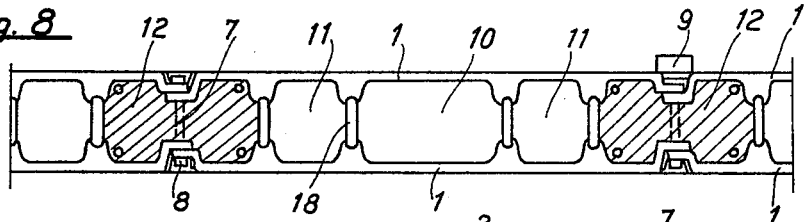
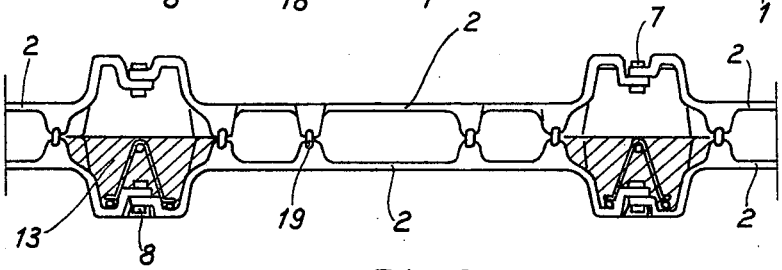
Fig. 9

ANNULAR STRUCTURES FOR THE ERECTION OF BUILDINGS

The subject matter of this invention consists of two modular units having the appearance of a thin plate, with which many such units can be coupled in such a way as to provide structures that are substantially annular and can be connected to permit building of rooms.

It is known for erecting buildings to make recourse to the use of prefabricated structural elements with the purpose of obtaining savings both in labor cost and in operational times.

However, the prefabrication methods now used do not permit to completely satisfy the various exacting requirements for the construction, so that it becomes impossible to obtain a strict check on the final costs and at the same time have adequate flexibility and adaptability on surface/volume bases of the prefabricated units.

The main object of this invention is to provide light weight modular elements, many of which can be coupled so as to form a structure having an annular shape which, seen as two vertical parallel sections, is similar to a room.

Another object of this invention is to provide modular units or elements that can be coupled with others by applying simple means.

An additional object of this invention is to provide modular units that can create, when abutted or overlapped, hollow spaces usable in various ways.

The objects described above can be advantageously obtained by coupling compatible and/or overlapped modular units the plan of which is substantially rectangular.

These modular units consist of a light weight plate having a small thickness and provided with ribs on one face, the other face being flat or curved.

This plate may have different shapes depending on its use, and its shape may be of one kind when it is used for a wall, of another for a ceiling, and of another for a floor.

The same plate or elementary component permits to obtain annular structures by connecting four specimens that are situated according to the sides of a rectangle.

By uniting these annular structures, coaxially or staggered, and by assembling them a tubular room is so constructed that can be easily transported and erected on the spot.

In particular, the ribbed faces of the elementary components are turned outwards so that when several habitation rooms are put side-by-side or put one over the other, vertical and horizontal hollow spaces are thus created.

Inside these hollow spaces, the thickness of which may be varied by inserting spacers provision can be made to install technological plants, thermal-acoustic corrective means and metal frames as deemed necessary.

To be more specific, this equipment is arranged outside each room allowing for its later mounting in the structure to be built.

Later on, after having mechanically coupled the rooms placed side-by-side, the pouring of concrete of the supporting microstructures are carried out on site inside the vertical framed hollow spaces that in this way work as shutterings.

Before laying a second row of spaced rooms over the first row of side-by-side arranged rooms which define the upper horizontal hollow space, aggregate beams are formed and welded to the various pillars obtained on the sides of these rooms.

At this point it is proper to point out that these supporting structures under particular loads may concern several hollow spaces or even entirely fill them.

The accompanying drawings show details of the invention and in the drawings:

FIG. 6 is a perspective view of two annular structures obtained by connecting the plates mentioned above;

FIG. 7 is a perspective view of the upper part of these annular structures when coupled;

FIG. 8 shows a horizontal section of two annular structures;

FIG. 9 shows a cross section of the adjacent plates of two annular structures arranged one over the other.

Figure 2:
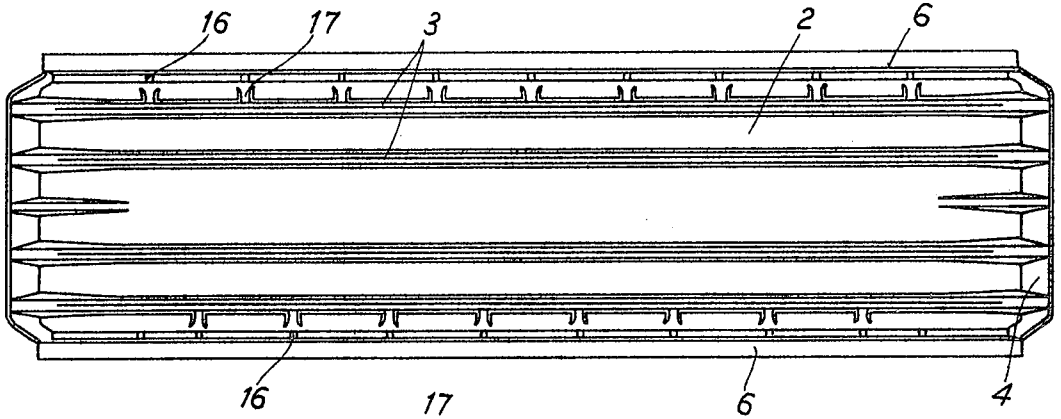
FIG. 2 is an elevation of the plate for a ceiling or slab
Figure 3:
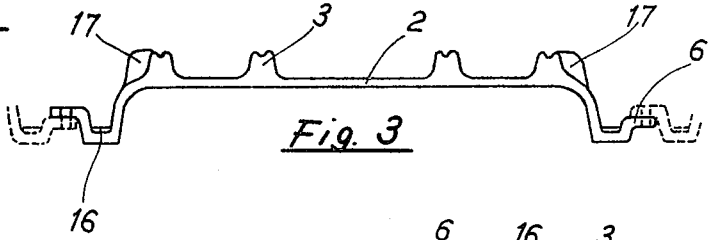
FIG. 3 is a cross section of the ceiling-slab plate shown in FIG. 2.
Figure 4:
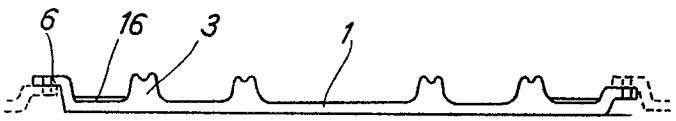
FIG. 4 is a horizontal section of the plate for a wall given in FIG. 1.
Figure 5:
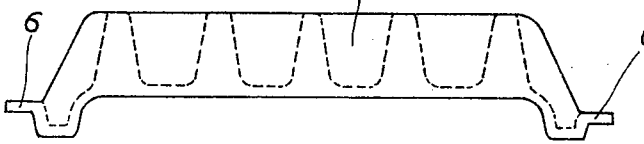
FIG. 5 is an elevation of the connection flange provided along the plate length end.
Figure 1:
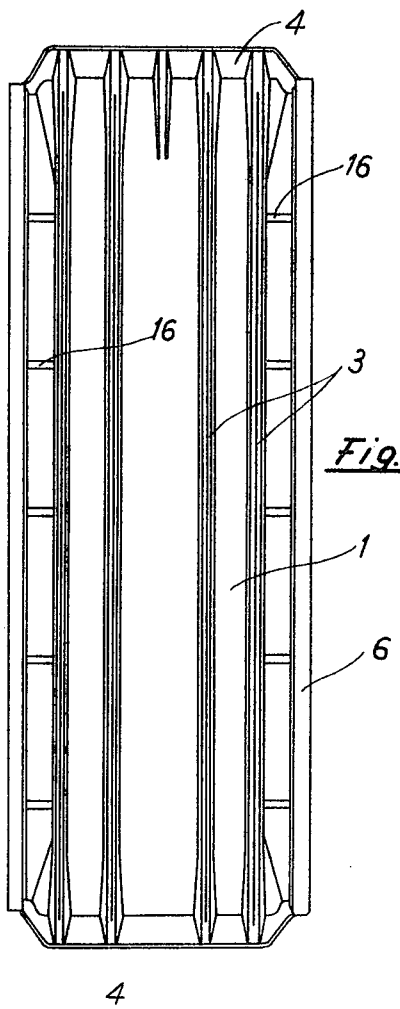
FIG. 1 is an elevation of the plate for a wall.

The modular units are formed respectively by one flat plate 1 and one plate having the longitudinal edges curved up 2.

Both plates are provided lengthwise with parallel outer ribbings 3 that are spaced apart so as to create hollow spaces with the other plates set side-by-side.

These plates are curved along their longitudinal end thus forming a connection flange 4 that permits anchoring (FIG. 7) by means of a number of bolts 5.

In this way it is possible to obtain an annular structure; many such elements can be connected axially. This connection is carried out by overlapping or simply putting side-by-side the edges 6 and the plates 1 and 2 mentioned above.

These plates are anchored one to the other by means of bolts 7, or studs, the nuts of which are visible and preferably lined with snap profiles 8 made of PVC or other suitable plastic material; this is put in the slot formed between one plate and the next.

In particular this slot is the preferred point of connection for the internal partitions, if any, 9 that are directly bolted to the supporting structure.

The wider hollow spaces 10 bounded by the walls of two side-by-side annular units may serve as warm air ducts for conditioning purposes thus transforming the plates into radiant elements and eliminating any phenomenon of condensation.

As an alternative, it is possible in very many areas to provide for extracting the air out of these hollow spaces, so that the thermal bridges of convection are reduced.

The other hollow spaces 11, in turn, can be advantageously used for accommodating the conduits of technical services.

The vertical spaces 12 defined by the side portions of the coupled annular elements and accommodating the frames are filled with aggregate cast so that to form pillars that support the beams 13.

These are solidified by filling with aggregate the channels 14 that are defined by the coupling of the upper plates, and by arranging for fitting a reinforcement 15 inside these channels.

In this connection it is stressed that along the vertical spaces 12 and channels 14 projecting ridges 16 maintain spacing between the reinforcement and the plates 1 and 2.

The plates 2 for a ceiling or slab are provided with two staggered sets of lateral feet 17 that rest on the underlying beams.

Between the vertical side-by-side plates 1 of two annular elements, there are inserted spacing elements 18 the width of which is a function of the constructional requirements.

Similarly, gaskets 19 are fitted in between the horizontal overlapped plates.

By assembling in a plane and along a straight line the annular structure mentioned above it is possible to obtain a tubular unit having any desired length; inside its space it is possible to fit vertical partitions so that this space is suitably divided.

Preferably these partitions should be formed by panels having openings that can serve as windows and doors.

The same openings can be provided for doors and windows in the vertical plates 1 and in the relevant companion plates that are flat and form the outer walls.

The hollow plate 2 of the base is filled with light concrete in order to provide a floor.

I claim:

1. In combination, for the formation of an annular building structure:

i. first modular units in the form of a substantially rectangular plate, said first units having:
   a. side flanges along each longitudinal edge to receive means for securing a unit to another similar unit,
   b. a plane internal major face to bound the internal space of the building structure,
   c. a plurality of ribs projecting from an external major face, said ribs being adapted with the corresponding ribs of another opposed first unit to bound a plurality of channels for services,
   d. end flanges to receive means for securing the unit to a second unit;

ii. second modular units in the form of a substantially rectangular plate, said second units having:
   a. side flanges along each longitudinal edge to receive means for securing the unit to another similar unit,
   b. a concave internal major face to bound the internal space of the building structure,
   c. a plurality of ribs projecting from an external major face, said ribs being adapted with the corresponding ribs of another opposed second unit to bound a plurality of channels, for services,
   d. end flanges to receive means for securing the unit to a first unit.

2. The combination of claim 1, wherein said second annular unit comprises two sets of feet extending laterally from a respective outer rib at positions which are staggered in the longitudinal direction of the unit.

3. A building structure comprising two first modular units as set forth in claim 1, disposed in opposed parallel positions, and two second modular units as set forth in claim 1 disposed in opposed parallel positions, each first unit being connected by its end flanges to the respective end flanges of the second units, thereby to constitute an annulus.

4. A building structure comprising a plurality of the annular building structures of claim 3 disposed coaxially and with each annular structure connected to the next annular structure by their respective side flanges.

5. A building structure comprising two of the annular building structures of claim 3 disposed in alignment side by side, the two structures being connected at the side flanges of the units, a plurality of spacing elements engaged between corresponding ribs of the units of each structure, and concrete pillars housed in channels defined between the first modular units of the respective structures.

6. A building structure comprising two of the annular building structures of claim 3 disposed in alignment on upon the other, the two structures being connected at the side flanges of the units, a plurality of spacing elements engaged between corresponding ribs of the units of each structure, and concrete cross beams housed in channels defined between the second modular units of the respective structures.

* * * * *